United States Patent [19]

Higgins

[11] 4,078,983

[45] Mar. 14, 1978

[54] DIGITAL CONTROL OF ELECTROLYTIC CURRENT

[75] Inventor: David L. Higgins, Palos Verdes Estates, Calif.

[73] Assignee: AG-MET, Inc., Lofty, Pa.

[21] Appl. No.: 719,697

[22] Filed: Sep. 2, 1976

[51] Int. Cl.[2] ..... C25B 15/02; C25C 1/20

[52] U.S. Cl. ..... 204/228; 204/109

[58] Field of Search ..... 204/228, 109

[56] References Cited

U.S. PATENT DOCUMENTS

| | | | |
|---|---|---|---|
| 3,463,711 | 8/1969 | Geyken | 204/109 |
| 3,616,435 | 10/1971 | Favell et al. | 204/228 |
| 3,925,184 | 12/1975 | Cave | 204/228 X |
| 4,018,658 | 4/1977 | Alfin et al. | 204/228 X |

*Primary Examiner*—John H. Mack
*Assistant Examiner*—D. R. Valentine
*Attorney, Agent, or Firm*—Fitzpatrick, Cella, Harper & Scinto

[57] ABSTRACT

Electrical current used in electrolytic recovery of metals, such as silver, is controlled digitally by causing pulses from an oscillator operating at a first frequency to be counted during introduction of silver bearing salts into solution and causing the electroplating current to correspond to the cumulative count. Thereafter, following salt introduction, the oscillator is operated at a second frequency, corresponding to the previously accumulated count, and the counter is counted down at this second frequency while the electroplating current is correspondingly reduced.

13 Claims, 4 Drawing Figures

DIGITAL CONTROL OF ELECTROLYTIC CURRENT

CROSS REFERENCE TO RELATED APPLICATIONS

This application discloses subject matter disclosed in copending application Ser. No. 534,159, filed Dec. 19, 1974, now U.S. Pat. No. 3,980,538, issued Sept. 14, 1976, and its divisional application Ser. No. 681,605, filed Apr. 29, 1976. This application is directed to an improvement to the inventions set forth in those applications.

BACKGROUND OF THE INVENTION

Field of the Invention

This invention relates to the electrolytic recovery of metals and more particularly, it concerns novel methods and apparatus for monitoring and regulating current in an electrolytic bath.

Description of the Prior Art

United States Patents Nos. 3,418,225, 3,450,622, 3,463,711, 3,551,318 and 3,616,435 all relate to the recovery of silver from used photographic or X-ray plates. In the systems described in those patents, silver bearing material is dissolved off from a film plate as it passes through a solution; and then the silver is recovered by subjecting the solution to electrolytic action so that the silver plates out onto a removable electrode. Various arrangements are provided for control of the electrical current through these solutions, including means for maintaining current flow for given lengths of time corresponding to the size and number of film plates passing through the solution. Means are also provided for manually adjusting the magnitude of current flow.

In U.S. Pat. No. 3,067,123 there are shown a pair of electrodes which sense the current flow in an electrolytic bath and which feed back a signal to drive a potentiometer so that the current flow is maintained at a constant or fixed value.

The aforementioned application Ser. No. 534,159 discloses an improvement to the foregoing prior art in that it provides control current means which operate in response to events which increase metal concentration, e.g. the entry of film plates into a processing operation, to increase plating current and which further operate after such event to decrease the plating current gradually to coincide, in general, to the concentration of metal, e.g. silver, in the solution. The system described in that application makes use of a charging capacitor which is connected to receive a charge in one direction at a first predetermined rate during the time a film plate passes into a processing bath. The capacitor is also arranged to receive a charge in the opposite direction, i.e. a discharge, at a second predetermined rate following the passage of each film plate into the bath. Electronic means are provided to sense the charge on the capacitor and to control the magnitude of current between a pair of plating electrodes placed in the bath.

SUMMARY OF THE INVENTION

The present invention provides additional improvements to the electrolytic recovery systems of the prior art in that it provides for a very accurate and stably controlled current flow through an electrolytic bath independently of temperature and other conditions. Moreover, with the present invention, current flow through an electrolytic bath is caused to decrease at a predetermined rate which corresponds reliably to the maximum value of current which results from the entry of a film plate into an electrolytic bath. This rate, according to the present invention, is predetermined to ensure that the current level through the electrolytic bath at any instance is as high as possible without producing sulphiding conditions. At the same time the current flow is maintained for a duration sufficient to provide a proper amount of ampere-hours of electrical energy through the electrolytic bath to correspond to the amount of silver which has been put into solution in the bath from the film plates passing through the bath.

There has thus been outlined rather broadly the more important features of the invention in order that the detailed description thereof that follows may be better understood and in order that the present contribution to the art may be better appreciated. There are of course, additional features of the invention that will be described hereinafter and which will form the subjects of various ones of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein:

FIGS. 3A and 3B together constitute a circuit diagram showing in detail the various elements making up the block diagram presented in FIG. 1.

DETAILED DESCRIPTION OF THE PREFERRED EMBODIMENT

Figure 1:
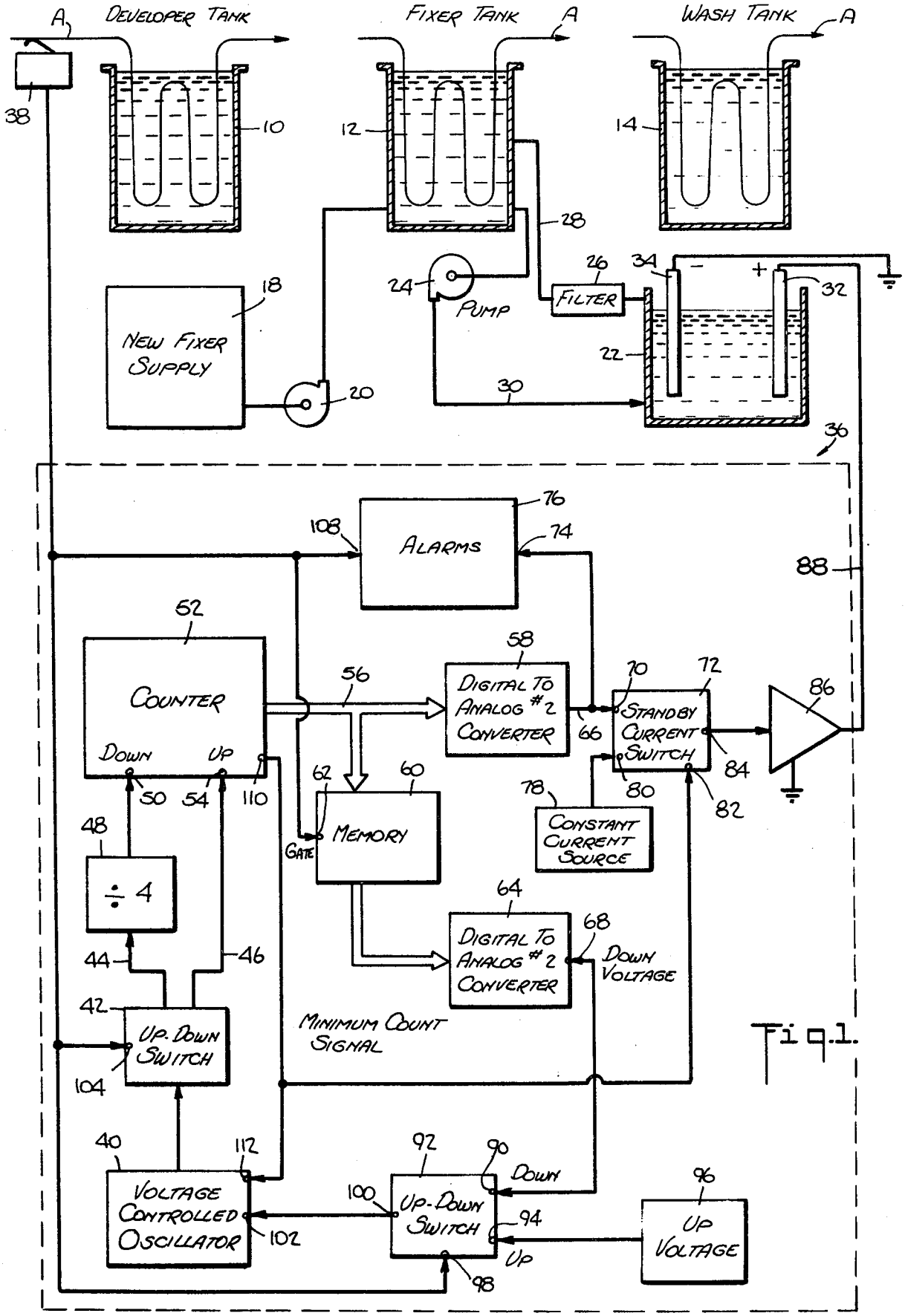
FIG. 1 is a diagrammatic representation of a film processing system including a block diagram of a current control arrangement for said system according to the present invention.

In the film processing system of FIG. 1, exposed photographic film plates, e.g. from a camera or an X-ray machine, are processed by developing and fixing images thereon. In the fixing operation silver salts from the film surface pass into solution.

As shown in FIG. 1, film to be processed passes along a path indicated by the arrows A. This path leads first through a developer tank 10, then through a fixer tank 12 and finally through a wash tank 14. The chemistry of this film processing operation is not part of this invention and will not be discussed herein except to say that in the fixer tank 12, silver containing materials become removed from the surface of the film and are dissolved into a fixer solution 16 contained within the tank. As the film moves out of the tank 12 it takes with it some of the fixed solution and so a replenishment arrangement is provided comprising a new fixer supply 18 and a new fixer pump 20 connected to transfer new fixer from the supply 18 to the fixer tank 12.

A silver recovery arrangement is provided and comprises a silver recovery chamber 22, a recycling pump 24 and a filter 26. The pump 24 and filter 26 are connected along a recovery conduit 28 to transfer silver containing solution from the fixer tank 12 to the recovery chamber 22. A return conduit 30 transfers silver free solution back to the fixer tank 12.

The silver recovery chamber 22 is provided with a pair of electrodes, i.e., an anode 32 and a cathode 34, which are connected, respectively, to a current control module 36 (shown in dashed outline). The current control module, as will be described more fully hereinafter, serves a maintain proper potential between the anode 32 and cathode 34 so that maximum effective electrical current passes through the solution in the chamber consonant with the concentration of silver therein.

Silver concentration within the recovery chamber 22 is affected by the rate at which film passes through the system. This is measured by a film sensing switch 38 at the entrance to the developer tank 10. As indicated in FIG. 1, the switch 38 is connected to the current control module 36.

During operation of the system as thus far described film plates to be processed pass under the switch 38 and into the developer tank 10. From there each film plate passes through a fixer tank 12 and then through the wash tank 14. In the fixer tank 12, the silver bearing salts on the film plates pass into solution and this solution is then transferred via the recycling pump 24 into the silver recovery chamber 22. The silver in the solution is recovered in the silver recovery chamber 22 by virtue of the electrical current passing through the solution between the anode 32 and the cathode 34 therein. This current causes the silver to become plated on the surface of the cathode.

The amount of current passing between the electrodes 32 and 34, i.e. the plating current, controls the rate at which silver is recovered from solution. However, if the plating current is too high, other materials in the solution will also be plated out on the cathode and will affect the purity of the silver thus recovered. This phenomonon, known as "sulphiding", is therefore to be avoided. It happens that the current magnitude at which sulphiding begins to take place varies according to the concentration of silver in the solution. Thus, when the solution has a high silver content, a relatively large magnitude of plating current can be tolerated without the occurrence of sulphide, but as the silver concentration in the solution diminishes the magnitude of the plating current must be reduced in order to remove silver from the solution at the highest possible rate.

In the system of FIG. 1 the plating current in the silver recovery chamber 22 is controlled by the current control module 36 and this, in turn, is made to coincide with the actual silver concentration in the silver recovery chamber during operation of the system. This relationship between silver concentration and current magnitude is obtained through the action of the film sensing switch 38 at the entrance of the developer tank 10. This switch is in one state, i.e. either opened or closed, during the movement of each film plate into the system; and it is in the opposite state when no film plate is entering the system. The film plates are of substantially uniform width and their rate of movement into the system is essentially constant. Therefore, the periods of time during which the switch 38 is in its first state correspond to the amount of silver bearing material which is passing into solution; and the durations in which the switch 38 is in its opposite state correspond to the reduction of silver concentration in the solution as a result of the electrolytic action taking place in the silver recovery chamber 22.

The current control module 36 operates to increase the plating current at a first predetermined rate to coincide with the increase in silver concentration in the bath as each silver bearing film plate moves into the system, i.e. while the switch 38 remains in its first state. In addition, the current control module 36 operates to decrease the plating current at a second predetermined rate to coincide with the resulting decrease in silver concentration in the bath from electroplating following movement of each film plate into the system, i.e. while the switch 38 remains in its first state. It will be appreciated that the electroplating action continues to occur while each film plate is moving into the system; but the rate of reduction of silver concentration at this time is considerably less than the rate of increase in silver concentration due to the addition of silver bearing salts from incoming film plates. Accordingly, there is a net increase in silver concentration in the solution during the movement of each film plate into the system.

The increase of plating current during the entry of film plates into the system and the decrease of plating current following the entry of each film plate into the system is controlled by the current control module 36 so that at each instant the plating current will be close to the maximum possible magnitude, for fastest silver recovery, without exceeding the magnitude which would result in sulphiding at the silver concentration level in the bath.

The amount of silver recovered and therefore taken out of solution by the plating action of the electrodes 32 and 34 corresponds to the time integral of the current passing between the electrodes. That is, a particular number of ampere hours of current will result in the plating out of a corresponding number of grams of silver. Because of this, the plating out of silver occurs at a greater rate when the silver concentration (and therefore the plating current) is highest. However, when the plating out occurs at a high rate, the concentration of silver in the solution decreases at a correspondingly high rate. Thus, in order to avoid sulphiding it is necessary that the plating current be decreased at greater rates when it has been raised to higher magnitudes; in other words, the rate of decrease of plating current must correspond to the magnitude to which it had been raised during the preceding film plate entry into the system. This is achieved in the present invention by virtue of the current control module 36 which not only causes a reduction in current during each interval in which the switch 38 is in its opposite or second state; but in addition it causes the current to decrease at a rate which is proportional to the highest magnitude reached by the current during the entry of the immediately preceding film plate into the system.

The current control module 36, as shown in FIG. 1, comprises a voltage controlled oscillator 40 whose output is directed through a first up-down switch 42 and from that switch through either a down-count line 44 or an up-count line 46, depending upon the presence of an energization signal at an updown switch control terminal **42*a*. The oscillator signals which pass through the up-count line 44 are directed through a divider circuit 48 to a down-count input terminal 50 of a counter 52**. Similarly, the signals from the voltage controlled oscillator 40 which pass through the up-count line 46 are applied directly to an up-count input terminal 54 of the counter 52. The signals produced by the voltage controlled oscillator 40 are shaped by means of well known circuit elements (not shown) to form digital pulses which, when applied to the counter 52, can be accumulated or registered in the counter. The number of pulses accumulated in the counter 52 at any given time corresponds to the difference between the number of pulses applied to its up-count input terminal 54 and the number of pulses applied to its down-count input terminal 50.

The accumulated pulse count in the counter 52 is transferred via counter output line 56 both to a first digital to analog converter 58 and to a memory circuit 60. The memory circuit 60 is provided with a gate terminal 62 which responds to energization signals to retain a particular count previously received from the counter 52 during a particular interval even though during that interval the count condition of the counter 52 may be changed. The pulse count which has been stored in the memory circuit 60 is applied to a second digital to analog converter 64. Both the first and second digital to analog converters 58 and 64 operate to produce at an associated output terminal 66 and 68, a direct current (DC) signal whose magnitude corresponds to the pulse count which is received from the counter 52 or from the memory 60. The DC signal produced by the first digital to analog converter 58 is applied to a first input 70 of a standby current switch 72. This same DC signal is also applied to a first alarm input 74 of an alarm system 76. A constant current switch 78 is provided to supply direct current at a fixed magnitude to a second input terminal 80 of the standby current switch 72. The standby current switch 72 is provided with a switching terminal 82 which responds to energization signals to switch the DC signals at the input terminals 70 and 80 alternately to a common output terminal 84. This output current is directed to an amplifier 86 to an output line 88 and from there to the first electrode 32 in the silver recovery chamber 22.

The output terminal 68 of the second digital to analog converter 64 is connected to a "down" input terminal 90 of a second up-down switch 92. The up-down switch 92 is also provided with an "up" input terminal 94 which is connected to receive a constant input voltage from an "up voltage" electrical source 96. The second up-down switch 92 is further provided with an up-down control terminal 92*a* which also receives energization signals, causing the switch to direct either the voltage from the second digital to analog converter 64 or the voltage from the up voltage source 96 to an output terminal 100. This output terminal is connected to a voltage control terminal 102 on the voltage controlled oscillator 40; and the oscillator 40 operates at a frequency corresponding to the voltage applied to the terminal 102.

The film sensing switch 38 is connected to produce the electrical energization signals for the control terminals 42*a* and 92*a* of the first and second up-down switches 42 and 92 and the gate terminal 62 of the memory 60. These signals are communicated from the switch 38 to these control, gate and switching terminals via a line 106. The complete circuits for providing energization signals on the line 106 in response to actuation of the switch 38 are not shown in detail, but it will be understood by those skilled in the art that there are many well known ways to provide signals on the line 106 which correspond to the condition of the switch 38. It is sufficient to say that the switch 38 is arranged such that when it is in its state corresponding to the movement of a film plate into the system, i.e. its first state, the signals on the line 106 are effective to cause the first up-down switch 42 to direct oscillator output pulses via the up-count line 46 to the up-count terminal of the up-down counter 52. Also, when the switch 38 is in its first state the signals on the line 106 cause the second up-down switch 92 to direct the voltage from the up-voltage source 96 to the control terminal 102 of the oscillator 40. At the same time the memory 60 is caused to clear itself of previously retained data. Conversely, when the switch 38 is switched to its second state, i.e. corresponding to a situation after a film plate has moved into the system, the resulting signals on the line 106 cause the first up-down switch 42 to direct oscillator output pulses via the down-count line 44 and the divider 48 to the down-count input terminal 50 of the up-down counter 52. Also at this time the second up-down switch 92 is switched to direct the output from the second digital to analog converter 64 to the control terminal 102 of the oscillator 40. In addition, the memory 60 is controlled to preserve the count it received from the counter 52 as of the time the switch 38 is switched to its second state, so that the second digital to analog converter receives a constant output from the memory 60 corresponding to the count present in the counter 52 as of the time the switch 38 is switched to its second state.

The counter 52 is also provided with a minimum count output terminal 110 which produces a minimum count signal whenever the count present in the counter 52 decreases below a predetermined minimal amount. This minimum count signal is applied to the control terminal 82 of the standby current switch 72 and to a standby terminal 112 of the voltage controlled oscillator 40.

The current control module 36 operates in response to the film sensing switch 38 to cause plating current to increase at a first predetermined rate during the interval and each film plate moves into the system and to cause a plating current decrease during the interval following entry of each film plate into the system and prior to entry of the next subsequent film plate. Further, the control module 36 operates to control the plating current decrease rate such that it corresponds to the magnitude of plating current attained at the time the previous film plate has entered the system.

Action of the control module 36 to increase plating current during entry of a film plate will now be described. During this time the switch 38 is in its first state and the resulting signal on the line 106 causes the switch 92 to direct a constant voltage from the source 96 to the oscillator 40 so that it produces output pulses at a predetermined constant or fixed frequency. The signals on the output line 106 also cause the switch 42 to direct the oscillator output pulses to the up-count terminal 54 of the up-down counter 52 so that its count increases, also at a fixed rate. The continuously increasing count in the counter 52 is converted by the first digital to analog converter 58 to a correspondingly continuously increasing current; and this current is directed through the standby current switch 72 and amplified by the amplifier 86 and supplied to the plating electrodes 32 and 34. Thus, the plating current in the bath rises at a fixed rate during the interval that a film plate moves into the system and maintains the switch 38 in its first state.

The action of the control module 36 to decrease the plating current at a rate corresponding to its magnitude at the time a film plate has completed its entry into the system will now be described. During the time the switch 38 is in its second state and the resulting signal on the line 106 causes the switch 92 to direct the output of the second digital to analog converter 64 to the oscillator 40 so that it produces output pulses at a frequency corresponding to the frequency supplied to the converter 64 from the memory 60. Since the switch 38 is in its second state the memory retains in the memory the counter output which existed at the time the switch 38 was switched to its second state. Thus, the voltage output from the second digital to analog converter 64 and the resulting output frequency of the oscillator 40 correspond to the magnitude of plating current as of the time the preceding film plate completed its entry into the system.

The oscillator pulses are directed during this time through the divider circuit 48 to the down-count terminal 50 of the counter 52 to reduce the accumulated count in the counter. This decreasing counter output is converted in the first digital to analog converter to a correspondingly decreasing current which, after passing through the standby current switch 72 and the amplifier 86, causes the plating current to be reduced accordingly. It will be noted that the memory 60 is unaffected by the decreasing output of the counter 52 during this interval so that the voltage control applied to the oscillator remains constant and the counter receives count down pulses from the oscillator at a fixed rate so that the resulting plating current decreases lineraly.

It will be noted that because of the divider circuit 48 in the down count line 44, a factor is introduced in the rate of decrease of accumulated count in the counter 52. This factor is governed by the various operating parameters of the systems such as film width, etc. In general, it will be necessary to have the counter count down at a slower rate than it counts up because the increase in silver concentration resulting from the page of film plates in the fixer tank solution is greater than the rate of decrease in silver concentration as a result of the plating action.

Occasionally it happens that the accumulated count in the counter becomes reduced to a level at which little if any current is caused to flow between the plating electrodes 32 and 34. It has been found that operation of the system is impaired if this current magnitude decreases below a certain predetermined level. In order to maintain a certain minimum current through the electrodes 32 and 34 at all times, the minimum count output terminal of the counter 110 is connected to the standby current switch 72 to cause that switch to direct current from the constant current source 78 to the amplifier 86 and the electrodes 32 and 34. The counter terminal 110 is also connected to a standby terminal 112 of the oscillator 40 to prevent the oscillator from continuing to produce output pulses which would reduce the accumulated count in the counter even further.

Figure 2:
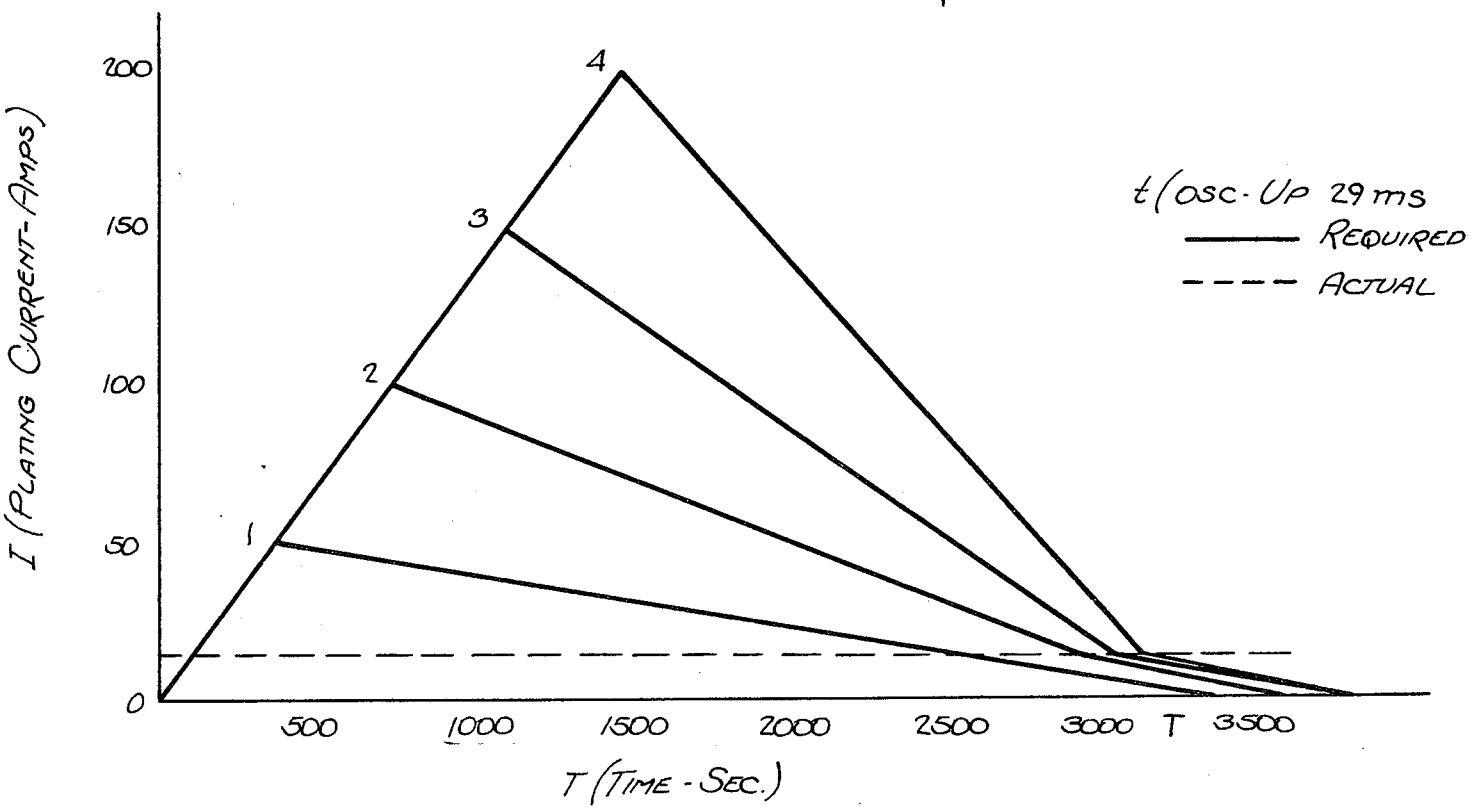
FIG. 2 is a graph illustrating the operating characteristics of the system of FIG. 1.
Figure 4A:
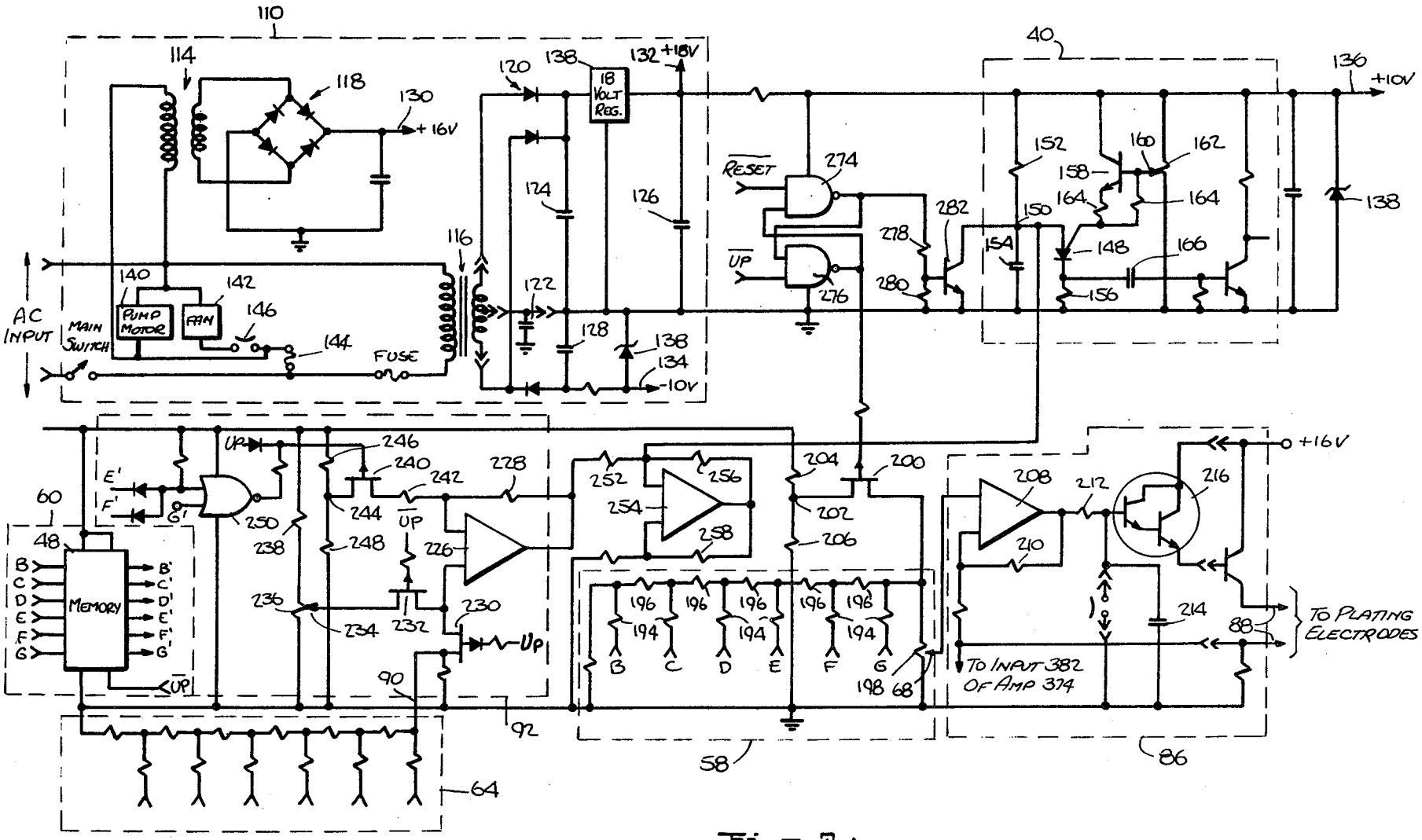

The parameters of the system of FIG. 1 are chosen such that within normal operating limits, the duration between the time of entry of a film plate into the system when silver concentration and plating current are at a minimal value and the time that the plating current is returned to that value is always essentially the same irrespective of the length of each film plate, i.e. irrespective of the duration of film plate entry and corresponding silver concentration and plating current increase. This is illustrated in FIG. 2 which shows, superimposed, plots of plating current against time for various different film plate lengths (i.e. entry durations). As can be seen from the preceding description of FIG. 1, the rate of current increase during entry of film plates into the system remains constant for each film length. This is shown in FIG. 2 by the line 0-1-2-3-4. On the other hand, the current decrease following entry of the film plate into the system is greater where the film plate is longer than it is when the film plate is shorter as seen by the lines 1-T, 2-T, 3-T and 4-T. It has been found that if the rate of current decrease is chosen such that it returns to its minimal value (0) at approximately the same time (T) following the beginning of its increase, irrespective of how much it has increased, it is possible to provide the proper amount of current needed to effect silver recovery for various film plate lengths. In recovering silver by electrolytic action, the amount of silver recovered corresponds to the time integral of the plating current employed in the recovery operation. Thus, where silver is to be recovered from two film plates and one film plate is twice as long as the other, the amount of silver dissolved off from the one film plate will be twice that from the other; and correspondingly, the time integral of the current used for the one must be twice that for the other. As seen in FIG. 2 a longer film plate will cause a larger plating current than a smaller film plate, but a greater length of time is required to attain the larger plating current. In each event the area under the current-time line corresponds to the amount of silver recovered.

Figure 3B:
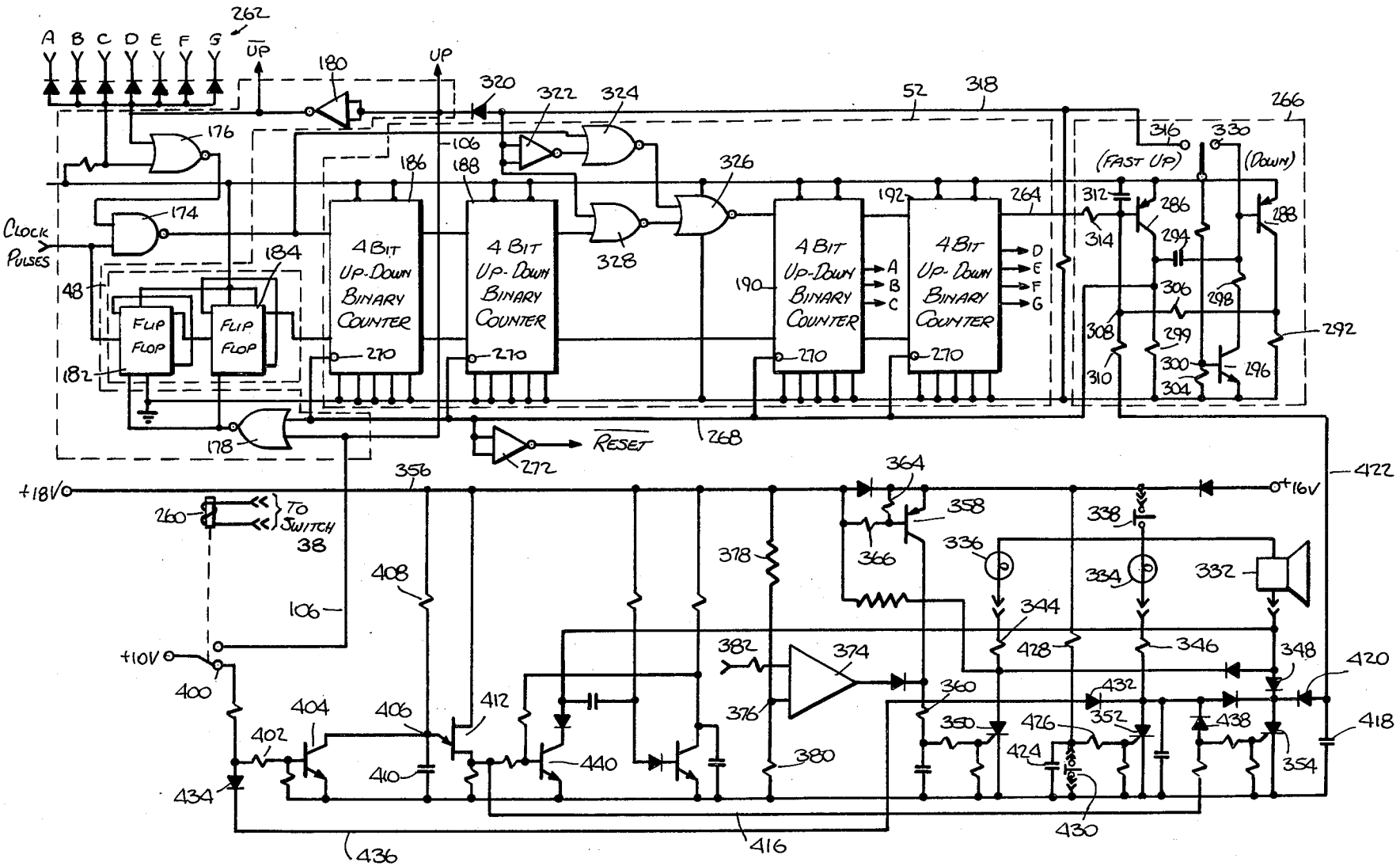

FIGS. 3A and 3B show in greater detail the current interconnections of the various components of the silver recovery system of FIG. 1. As shown in FIG. 3A there is provided a conventional power supply 110 which receives alternating current input power at a pair of terminals 112. The power supply includes transformers 114 and 116, full wave rectifiers 118 and 120 and smoothing capacitors 122, 124, 126 and 128 in the usual arrangement to provide constant direct current at a plus 16 volt terminal 130, a plus 18 volt terminal 132, a minus 10 volt terminal 134, and a plus 10 volt terminal 136. There are also provided voltage regulators 138 to maintain these voltages essentially constant.

A motor 140 for driving the pump 24 (FIG. 1) and a fan 142 are connected in series with a fuse 144 across the input terminals 112. A separate fan switch 146 is also connected in series with the fan 142.

The voltage controlled oscillator 40 comprises a silicon controlled rectifier (SCR) 148 having its anode connected to a junction 150 between a timing resistor 152 and capacitor 154, themselves connected between ground and the plus 10 volt terminal 136. The cathode of the SCR 148 is connected via a resistor 156 to ground. The gate terminal of the SCR is connected through the collector and emitter of a transistor 158 to the plus 10 volt terminal 136. The base of the transistor 158 is connected to the tap 160 of a frequency adjust resistor 162. The emitter of the transistor is also connected via resistors 164 and 166 to its base. Current surges caused by switching on and off of the SCR 148 are communicated from its cathode via a capacitor 166 to the base of a pulse amplifier transistor 168. This transistor is connected with a collector load resistor 170 between the plus 10 volt terminal 136 and ground. Clock pulses are obtained from a terminal 172 between the resistor 170 and the collector of the transistor 168.

Turning now to FIG. 3B it will be seen that the clock pulses from the terminal 172 are applied to the up-down switch 42 and are directed from it either through the line 46 to the up count terminal 54 of the counter 52 or through the divide by four circuit 48 to the down count terminal 50 of the counter. The up-down switch 42 comprises a NAND gate 174 and first and second NOR gates 176 and 178. The NAND gate 174, when open, transmits pulses directly through to the counter up count terminal 54. The NAND gate is opened by signals from the first NOR gate 176 and this in turn provides gate opening signals upon the reception of an UP voltage signal (i.e. NOT UP) from an inverter 180. The inverter in turn receives UP signals from the line 106. The second NOR gate 178 also receives UP signals from the line 106 and these signals are used to open the divide by four circuit 48 to pass pulses from the oscillator 40 (after they have been divided in number by four) to the down count terminal 50 of the counter. The divide by four circuit 48 comprises a pair of filp flop circuits 182 and 184 connected in the usual way so that when they receive a proper activation signal as from the second NOR gate 178 they will produce output pluses at one fourth the rate of applied input pulses. The counter 52 is made up of four synchronous 4 bit up/-down binary counter stages 186, 188, 190 and 192. The first two counter stages 186 and 188 divide the clock pulses from the oscillator by a factor of 256. The last two counter stages 190 and 192 count the thus divided pulses and drive the digital to analog 58. The digital to analog converter 58, which is shown in FIG. 3A, comprises a plurality of resistors 194 and 196 arranged to receive signals from selected outputs B, C, D, E, F, and G of the last two stages 190 and 192 of the counter 52. The output terminal 68 of the digital to analog converter 58 is the tap of an adjustable resistor 198. In the arrangement of FIG. 3A the standby current switch 72 is a field effect transistor 200 which has one base terminal connected in series with the adjustable resistor 198. The other base of the transistor 200 is connected to a voltage divider junction 202 between a pair of voltage divider resistors 204 and 206 which in turn are connected between the plus ten volt terminal 136 and ground. Depending upon the state of the transistor 200 either a constant minimum current or the output of the digital to analog converter 58 is applied to the current amplifier 86. This current amplifier as shown comprises an operational amplifier 208 with a feedback resistor 210. The output of the operational amplifier is connected through a series resistor 212 and parallel capacitor 214 to two stage transistor arrangement 216.

The memory 60 is a hexagonal type flip flop integrated circuit 218. This circuit has input terminals B, C, D, E, F and G to receive corresponding outputs from the counter stages 190 and 192. The circuit 218 also includes a plurality of output terminals B', C', D', E', F' and G' which are connected to corresponding terminals of the digital to analog converter 64. In addition, the circuit 218 has a further input terminal 62 connected to receive the $\overline{UP}$ signals for controlling the holding of applied signals and for clearing it.

The digital to analog converter 64 itself comprises pluralities of resistors 220 and 222 connected to add the voltages supplied from the output terminals of the memory circuit 218. The resulting voltage is applied through the base terminals of a field effect transistor 224 to the down input terminal 90 of the up-down switch 90.

The up-down switch 92 includes an operational amplifier 226 with a feedback resistor 228. The down input terminal is connected through the bases of a field effect transistor 230 to one input of the amplifier 226. In addition, this same amplifier input is connected through the bases of another field effect transistor 232 to the tap 234 of a charge rate and frequency adjust resistor 236 which in turn is connected in series with a further resistor 238 between the plus ten volt terminal and ground. A third field effect transistor 240 has its bases connected in series with a resistor 242 between a voltage divider junction 244 and the other input to the amplifier 226. The voltage divider junction is formed between a pair of resistors 246 and 248 connected between the plus ten volt terminal and ground.

The emitter terminals of the field effect transistors 230 and 240 are connected to receive $\overline{UP}$ signals while the emitter terminal of the field effect transistor 232 is connected to receive $\overline{UP}$ signals. A NOR gate 250 is also connected to supply signals to the emitter of the field effect transistor 240. One input of the NOR gate 250 is connected to receive a summed signal from the E' and F' output terminals of the memory circuit 218 while the other input of the NOR gate 250 is connected to receive a signal from the G' output terminal of the memory circuit 218. When an UP count signal is received, the transistors 230 and 240 are rendered non-conductive; and at the same time an $\overline{UP}$ signal is applied to the transistor 232 so that the amplifier 226 produces an output corresponding to the voltages at the tap of the charge rate and frequency adjust resistor 234. When an UP signal is not received, i.e. during a down count condition, the transistors 230 and 242 are in their opposite states and the amplifier 226 is controlled by the output of the digital to analog converter 64. However, when the down count drops below a predetermined amount (e.g. thirty two), the corresponding energized outputs of the memory 60, (e.g. outputs E', F' and G') are applied to the field effect transistor 240 so that it conducts and subjects the upper input of the amplifier 226 to the voltage at the junction 224 of the voltage divider circuit 246, 248. This changes the gain of the amplifier; and as will be seen, causes a reduction in the rate of current decrease so that it follows the non linear characteristic of the plating current at low silver concentrations (indicated by the dashed horizontal line on the graph of FIG. 2).

The output of the amplifier 226 is supplied through a resistor 252 and constant current control amplifier 254, with feedback resistors 256 and 258, to the anode of the SCR 148 of the voltage controlled oscillator 40. This output of the amplifier 226 is thus used to control the frequency of the oscillator 40 in accordance with the output of the digital to analog converter 64 during down counts and is used to control the frequency of the oscillator 40 in accordance with the output of the up voltage source 90 (i.e. the voltage divider resistors 236 and 238) during up counts.

The switching of the switches 42 and 92 is controlled by a relay 260 (FIG. 3B) which is connected (in a manner not shown) to be energized by operation of the switch 38. When the relay 260 is energized as shown in FIG. 3B the plus 10 volt terminal is connected to the line 106 to generate the UP and $\overline{UP}$ signals as described above. These signals are applied as above described to operate the switches 42 and 92 so that the oscillator output pulses are accumulated in the counter 52 as up count pulses. Thereafter upon completion of entry into the bath or solution, the relay 260 becomes deenergized and the UP and UP signals disappear. This, as explained above, causes the oscillator pulses to be accumulated in the opposite direction in the counter, i.e. they cause the counter to count down. It will be appreciated that in the present arrangement the counter 52 accumulates the up count pulses and the down count pulses and combines them algebraically. So that at any instant the count condition of the counter is the algebraic sum of the accumulated up count pulses and down count pulses.

The circuits of FIGS. 3A and 3B also provide various safety and alarm features which will now be described. Firstly, means are provided to prevent the counters from recycling, i.e. reverting to zero count upon reaching their maximum capacity. This means comprising a plurality of control rectifiers 262 connected to the counter output terminals A, B, C, D, E, F and G to apply their sum to the NOR gate 176 and thus to inhibit or close the NAND gate 174. A reset pulse also is applied from the last stage 192 of the counter 52 via a line 264 to a one-shot monostable multivibrator 266. This triggers the multivibrator causing it to generate a signal on a reset line 268 to a reset terminal 270 in each of the counter stages to clear them of all accumulated counts. This reset signal is also applied to one input of the NOR gate 178 causing it to place the divide by four filp flops in up count or signal blocking condition. Further, the reset signal is applied to an inverter 272 to generate a NOT RESET signal (indicated as $\overline{\text{RESET}}$). The $\overline{\text{RESET}}$ signal is applied to one input of a bistable flip flop circuit made up of a pair of cross coupled NAND gates 274 and 276. One output of this flip flop circuit is connected through a pair of voltage divider resistors 278 and 280 to the base of an oscillator control transistor 282 which is arranged to short circuit the capacitor 154 of the voltage control oscillator 40. Thus when a $\overline{\text{RESET}}$ signal is applied to the flip flop NAND gate 274 the oscillator is caused to turn off. A second output 284 of the flip flop is connected to the base of the field effect transistor 200 in a manner such that it is rendered conductive at the same time the oscillator 40 is turned off. This allows a minimum current, supplied by the voltage divider resistors 204 and 206, to be applied through the amplifiers 208 and 216 to the plating electrodes.

The one shot multivibrator 266 comprises a first pair of pnp transistors 286 and 288 each connected in series with a resistor 290 and 292 between the plus 10 volt terminal 136 and ground. A timing capacitor 294 interconnects the collectors of the two transistors. An npn transistor 296 is arranged with its collector connected through a resistor 298 to the base of the transistor 288 and its emitter connected to ground. The base of the timing capacitor is connected to a junction 300 between a pair of voltage divider resistors 302 and 304 connected in series between the plus 10 volt terminal and ground. The collector of the transistor 288 is connected through a resistor 306 to a junction 308 between a timing resistor 310 and capacitor 312 connected in series to the plus ten volt terminal 136. This same junction 308 is also connected to the base of the transistor 286 and through a resistor 314 to the overflow line 264 from the last counter stage 192.

A FAST-UP switch 316 is provided in conjunction with the multivibrator 266 and this switch, which is normally opened, may be closed to connect the plus ten volt terminal 136 to a FAST UP line 318. This line is connected through an isolation diode 320 to the $\overline{\text{UP}}$ line 106 and to the inverter 180 to generate UP and $\overline{\text{UP}}$ signals. The line 318 is also connected to a fast up inverter 322 and from there through first and second NOR gates 324 and 326 to the input of the third stage 190 of the counter 52. The remaining input of the first NOR gate 324 is connected to receive clock pulses directly. The remaining input of the second NOR gate 326 is connected to receive inputs from a third NOR gate 328 and this third NOR gate receives overflow signals from the second counter stage 188 as well as FAST UP signals from the FAST UP line 318 when the switch 316 is closed. The effect of this arrangement is to cause clock pulses to bypass the first two counter stages 186 and 188 and enter the third stage 190 directly. This permits the last stages of the counter to be driven to maximum count very quickly so that the system can be tested for maximum current output.

The switch 316 is also arranged with a DOWN switch terminal 330 which, when closed, causes the multivibrator 266 to trigger. In this manner the counter clearing and system resetting, which otherwise occurs upon counter overload, can be produced manually at any desired time.

The various alarms, indicated in FIG. 1 at 76 will now be described in detail in conjunction with FIG. 3B. As there shown, there is provided an acoustic alarm 332, a timer light 334 and a visual balance alarm 336. Each alarm is connected through a common manual reset switch 338 to a 16 volt line 340 which in turn is connected through a diode 342 to the plus 16 volt terminal 130 (FIG. 3A). These alarms are also connected via associated resistors 344, 346 or diode 348 and SCR switches 350, 352 and 354 to ground.

The visual balance alarm 336 operates whenever either a power supply failure from either the plus 18 volt or the plus 16 volt terminals 130 or 132 (FIG. 3A) occur. This alarm also operates whenever the plating current supplied to the amplifier 208 decreases below a predetermined minimum. As shown in FIG. 3B, the plus 18 volt terminal 130 is connected to a plus 18 volt line 356 which is connected through an isolation diode 358 to the plus 16 volt line 340. A pnp transistor 358 is connected between the 16 volt line 340 and a resistor 360 and capacitor 362 to ground. The base of the transistor 358 is connected to the junction between voltage divider resistors 364 and 366 connected across the isolation diode 358. When a power failure occurs either in the 16 volt line 340 or in the 18 volt line 356 the transistor 358 is switched and a signal is applied from the junction between the resistor 360 and capacitor 362 through a pair of voltage divider resistors 369 and 370 to the gate of the SCR 350. This lights the balance alarm 336. At the same time the acoustical alarm 332 is turned on by virtue of a connecting line 372 between that alarm and the anode of the SCR 350. When the plating current drops below a predetermined minimum the balance alarm 336 and the acoustical alarm are also activated. This occurs by virtue of current amplifier 374 whose output is connected to a junction between the transistor 358 and the resistor 360. This amplifier has one input connected to a junction 376 between a pair of voltage divider resistors 378 and 380 connected between the plus 18 volt line 356 and ground. The amplifier 374 has a second input 382 connected to the plating electrode line 88 at the amplifier 208 (FIG. 3A). When the current to the plating electrodes decreases below an amount determined by the voltage at the junction 376 the amplifier 374 supplies a signal to the SCR gate 350 to activate the balance alarm.

The acoustic alarm 332 also operates to produce a visual signal whenever the film detector switch is in a film entry sensing condition beyond a predetermined length of time. This prevents the generation of excess plating current in the solution in situations where the switch 38 may have become jammed. As shown in FIG. 3B there is provided a terminal 400 which receives a plus ten volt energization when the relay 260 is energized, that is, when a film plate is not entering the system. This ten volt energization is applied via a resistor 402 to the base of an npn transistor 404 maintaining the transistor in its conductive state. The collector of this transistor is connected to a junction 406 between a resistor 408 and a timing capacitor 410 connected between the plus 18 volt line 356 and ground. While the transistor 404 is conducting the junction 406 remains essentially at ground potential. However, when a film plate enters the system and the switch 38 (FIG. 1) deactivates the relay 260, the terminal 400 is removed from its ten volt supply and the transistor 404 is rendered non-conductive. As a result the capacitor 410 begins to charge. The junction 406 is connected to the emitter of a unijunction transistor 412. The size of the resistor 408 and capacitor 410 is set such that the voltage at the junction 406 will reach a level to trigger the unijunction transistor 412 about forty five seconds after the entry of a film plate into the system. This length of time is chosen to allow entry of the longest film plates without triggering the transistor 412 but short enough to prevent plating current from reaching undue levels in the event the switch 38 has become jammed. The bases of the transistor 412 are connected in series with a resistor 414 between the plus 18 volt line and ground and the voltage across the resistor increases when the transistor conducts. This voltage increase is communicated via a line 416 to the gate terminal of the acoustical alarm SCR 354 to turn on the acoustical alarm 332.

Whenever the acoustical alarm is turned on by operation of the SCR 354, the current flow causes a discharge of a capacitor 418 through a diode 420 and through the SCR 354. This capacitor discharge is communicated via a line 422 to the multivibrator 266 causing it to trigger to stop operation of the oscillator and to reset the counter 52.

From time to time it may be desired to process a film strip whose length is such that it takes longer than 45 seconds to enter the system. Means are provided to prevent the system from resetting during processing of these extra length films. As can be seen in FIG. 3B there is provided a timing capacitor 414 and resistor 426 between the gate of the timer light SCR 352 and ground. A timer resistor 428 is connected between the 16 volt line 340 and the junction between the capacitor 424 and resistor 426. Further, a normally closed manually operable switch 420 is connected across the capacitor 424 to prevent any charge from accumulating on it. When it is desired to process long films, the system is placed in a bypass mode by opening the switch 430. This allows the capacitor 424 to charge and trigger the SCR 352 to turn on the timer light 334 so that the bypass condition of the system is displayed. In addition, the switching of the SCR 352 to its conductive state allows current to flow through diodes 432 and 434 and line 436 from the base of the transistor 404 so that the base of this transistor becomes grounded and it no longer conducts. As a result current flows into the capacitor 410 until it triggers the unijunction transistor 412. The acoustical alarm 332 cannot be turned on by the resulting signal on the line 416 as previously described however, because the gate of its SCR 354 is in communication via a diode 438 to the anode of the now conducting timer light SCR 352. Because the gate of the acoustical alarm SCR is thus clamped to ground it cannot be turned on via the line 416.

On the other hand, the triggering of the unijunction transistor 412 causes it to trigger a monostable multivibrator formed of a pair of npn transistors 440 and 442 connected in the usual way. When triggering occurs the first transistor 440, which is normally non-conducting, is turned on and current flows from the acoustical alarm 332 through a line 444 and a diode 446 through the transistor 440 to turn on the alarm. In a very short period however the multivibrator reverts to its normal state and the transistor 440 stops conducting and turns off the alarm 332. In the meantime, a new charge begins to build up on the capacitor 410 so that after another 45 seconds a subsequent triggering of the unijunction transistor will occur. Thus in the bypass mode the timer light 334 remains on and the acoustical alarm 332 emits a short signal every 45 seconds but the system otherwise remains in normal operation.

It will be appreciated that the various NOR and NAND gates, the inverters and amplifiers, etc. are well known integrated circuit type electrical components used in digital electrical systems and they are readily available on the market. Similarly, the various stages of the counter 52 are well know synchronous 4-bit binary up-down counters. One example of these is the Type MM74C193N supplied by National Semiconductor Corporation of Santa Clara, California. The memory circuit 218 may be a known Hex "D" flip-flop such as type MM74C174N also supplied by National Semiconductor Corporation. The flip flop circuits 182 and 184 may be dual "D" flops of the type MM74C74N supplied by National Semiconductor Corporation. Also, the 18 volt voltage regulator 138 may be of the type LM340T-18 supplied by National Semiconductor Corporation.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by letters patent is:

1. A current control system for use in the electrolytic recovery of metal from a bath containing an electroplating solution into which a salt of said metal is introduced periodically, said bath containing a pair of plating electrodes immersed in said solution said current control means being operable to control the current through said electrodes, and comprising an oscillator for producing pulses at a controlled rate, an up-down counter connected to receive pulses from said oscillator, a digital-to-analogue converter connected to the output of said counter and operative to produce an output signal whose magnitude corresponds to the net count accumulated in said counter, means for adjusting the electric current through said electrodes in accordance with the output of said digital-to-analogue converter, and switch means responsive to the introduction of said salt to said solution, said switch means being operative to direct the output of said oscillator to cause said counter to count up during the introduction of salt into said solution and to cause the output of said oscillator to direct said counter to count-down following the introduction of said salt to said solution.

2. A current control system according to claim 1 wherein said oscillator is a voltage controlled oscillator whose output frequency varies with applied voltage.

3. A current control system according to claim 2 wherein said switch means is converted to direct a first fixed voltage to said oscillator to cause it to oscillate at a first fixed frequency during said introduction of said salt into said solution.

4. A current control system according to claim 3 wherein said switch means is connected to direct a second fixed voltage to said oscillator corresponding to the accumulated count in said counter at the end of said introduction of salt into said solution.

5. A current control system according to claim 1 wherein a memory circuit is connected to the output of said counter and wherein said switch means is arranged to maintain in said memory the count present therein at the end of said introduction of salt into said solution.

6. A current control system according to claim 1 wherein said switch means is connected to direct outputs from said oscillator to an up-count input terminal of said counter during said introduction of salt and to direct outputs from said oscillator to a down-count input terminal of said counter following said introduction of salt.

7. A current control system according to claim 5 wherein a second digital to analog converter is arranged to be connected between said memory means and said oscillator by said switch means following said introduction of salt into solution.

8. A current control system according to claim 1 wherein gate means are provided to prevent oscillator outputs from reaching said counter when said counter accumulates to a predetermined count.

9. A current control system according to claim 1 wherein reset means are provided to terminate operation of said oscillator when said counter accumulates a predetermined count.

10. A current control system according to claim 1 wherein timer means are provided, operable in response to operation of said switch means at the beginning of introduction of salt to said solution, to discontinue the accumulation of up-count pulses after a predetermined time following said beginning of introduction of salt.

11. A current control system according to claim 6 wherein a pulse count divider is interposed between said oscillator and said down-count terminal of said counter.

12. A current control system according to claim 1 wherein means are provided to maintain a predetermined minimum current through said electrodes in response to a decrease in the accumulated count in said counter beyond a predetermined amount.

13. A current control system according to claim 1 wherein means are provided to decrease the frequency of oscillation of said oscillator in response to a decrease in the accumulated count in said counter beyond a predetermined amount.

* * * * *

UNITED STATES PATENT AND TRADEMARK OFFICE

CERTIFICATE OF CORRECTION

PATENT NO. : 4,078,983

DATED : March 14, 1978

INVENTOR(S) : David L. Higgins

It is certified that error appears in the above-identified patent and that said Letters Patent are hereby corrected as shown below:

Drawing Sheets 1, 2, 3 and 4, "7,078,983" to read

-- 4,078,983 --.

Column 3, line 13, "a" to read -- to --.

Column 9, lines 8 and 10, "UP" to read -- $\overline{\text{UP}}$ --.

Column 10, line 12, "$\overline{\text{UP}}$" to read -- UP --.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*